United States Patent [19]

Kakimoto

[11] Patent Number: 4,979,415

[45] Date of Patent: Dec. 25, 1990

[54] PUNCHING UNIT FOR PUNCHING APPARATUS

[75] Inventor: Masakazu Kakimoto, Aichi, Japan

[73] Assignee: Ushio Co. Ltd., Aichi, Japan

[21] Appl. No.: 370,740

[22] Filed: Jun. 23, 1989

[30] Foreign Application Priority Data

Jul. 6, 1988 [JP] Japan ..... 63-90186[U]

[51] Int. Cl.[5] ..... B26F 1/04

[52] U.S. Cl. ..... 83/571; 83/698; 83/859

[58] Field of Search ..... 83/139, 143, 571, 573, 83/684, 686, 698, 859, 549, 552, 49, 548, 126, 123; 29/568; 51/165 R

[56] References Cited

U.S. PATENT DOCUMENTS

| | | | |
|---|---|---|---|
| 2,369,896 | 2/1945 | Harris et al. | 83/686 X |
| 3,165,962 | 1/1965 | Bredow | 83/552 X |
| 3,972,260 | 8/1976 | Hayashi et al. | 83/549 |
| 4,246,815 | 1/1981 | Hugo | 83/139 |
| 4,532,843 | 8/1985 | Miyama | 83/549 X |
| 4,621,407 | 11/1986 | Suzuki | 29/568 |
| 4,653,365 | 3/1987 | Takasaki et al. | 83/49 X |
| 4,682,524 | 7/1987 | Achelpohl | 83/549 X |
| 4,700,441 | 10/1987 | Ikeda et al. | 83/549 X |
| 4,794,835 | 1/1989 | Fujiyoshi | 83/835 |

FOREIGN PATENT DOCUMENTS 63-267195 11/1988 Japan .

*Primary Examiner*—Douglas D. Watts
*Assistant Examiner*—Kenneth E. Peterson
*Attorney, Agent, or Firm*—Sandler, Greenblum & Bernstein

[57] ABSTRACT

In a punching unit for punching apparatus comprising a support section of a generally C-shape with a material inserting groove formed in the middle, a punch vertically movably and removably mounted in a mounting bore in the side end of the upper half of the support section, a die removably mounted in the side end of the lower half of the support section and having a die opening formed conforming to the outer periphery of a working surface of the punch, and a lifting mechanism removably connected to the die, the working surface of the punch is formed in a shape of a concave slot, and a slug discharge bore is provided communicating with the die opening of the die and with the lower half part of the support section.

13 Claims, 2 Drawing Sheets

PUNCHING UNIT FOR PUNCHING APPARATUS

BACKGROUND OF THE INVENTION

1. Field of the Invention

The present invention relates to a punching unit for a punching apparatus and, more particularly, to improvements in the structure around a punch of the punching unit for a punching apparatus for producing holes in thin materials, such as ceramic green sheets, flexible films, metal films, prepregs, or the like.

2. Description of the Prior Art:

A punching unit for a punching apparatus has previously been proposed by the applicant of the present invention in Japanese Patent Application Serial No. Sho 62-102198.

The punching unit for a punching apparatus pertaining to the applicant's previous invention comprises a support section formed in a generally C-shape with an inserting groove provided in the center thereof for setting a material to be punched; a punch vertically movable and removably inserted in a mounting bore formed in the side end of the upper half of the support section; a die removably mounted at the side end of the lower half of the support section, and having a die opening which is conformable to the shape of the outer periphery of a working surface of the punch; and a lifting mechanism movably mounted on the upper half of the support section, and removably connected to the die.

According to the present applicant's previous invention the punching unit for a punching apparatus has such an advantage that various types of holes can readily be produced with the punch replaced with ease only by moving the vertically movable mechanism after disconnecting from the punch.

Problem the Present Invention Intends to Solve

The punching unit for the punching apparatus previously proposed by the present applicant is suitable for punching relatively small holes which the punch is required to pierce but still has a problem to be solved, Viz. that the punch unit is not fully applicable to punching relatively large holes which the punch is required to notch.

To solve this problem, the present invention has been accomplished, and it is an object of the present invention to provide a punching unit for punching apparatus that enables easy replacement of the punch and also thorough application to the punching of relatively large holes to be produced.

Means to Solve the Problems

To accomplish the aforementioned objects, in the punch unit for punching apparatus comprising a support section formed in a generally C-shape with an inserting groove provided in the middle for setting a material to be punched; a punch vertically moveable and removably inserted in a mounting bore provided in the side end of the upper half of the support section; a die removably mounted at the side end of the lower half of the support section, and having a die opening formed corresponding to the shape of the outer periphery of a working surface of the punch; and a lifting mechanism movably mounted on the upper half of the support section and removably connected to the die, there is adopted a means having a working surface with a concave section, and a slug discharge bore communicating with the die opening and with the lower half of the support section thereunder.

Function

The above-mentioned means, utilizing the prior-art structure for moving the lifting mechanism pertaining to the previous invention described above, can fulfil the object to enable easy replacement of the punch.

Also, since the material to be punched is notched and punched by the concave section of the working surface of the punch and slugs are discharged downwardly from the die opening, it is possible to accomplish the object to enable the application of the punch unit to the punching of relatively large holes.

Other objects and advantages of the present invention will become more apparent from the following detailed description of the preferred embodiment when read in connection with the accompanying drawings.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DESCRIPTION OF THE PREFERRED EMBODIMENT

Figure 1:
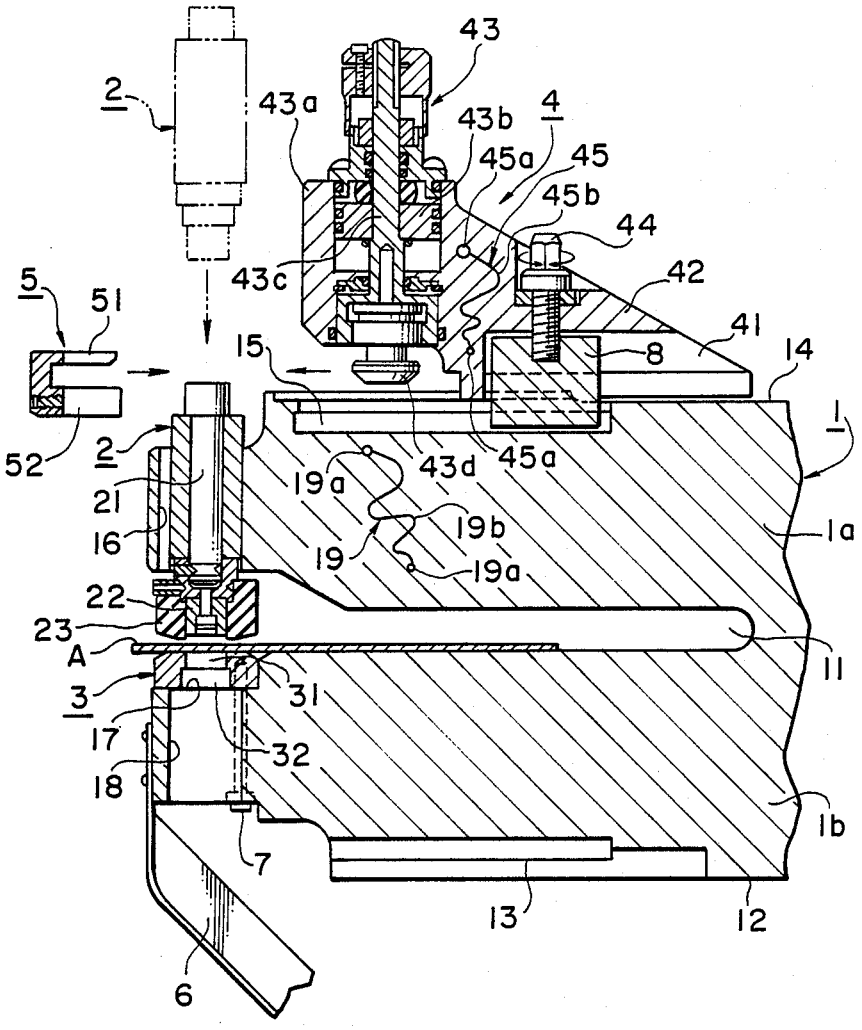
FIG. 1 is a sectional view showing the state of a punching unit for punching apparatus according to an embodiment of the present invention prior to installation.
Figure 3:
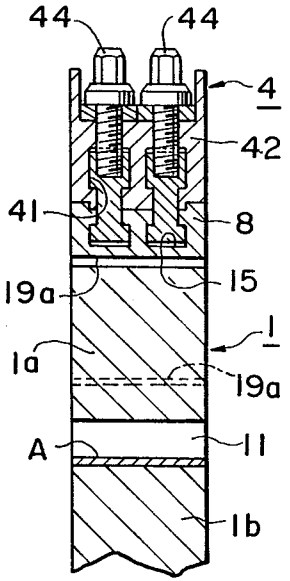
FIG. 3 is a sectional view taken along line X—X in FIG. 2.

Hereinafter an exemplary embodiment of a punching unit for punching apparatus according to the present invention will be described with reference to the accompanying drawings.

In this embodiment, the punching unit is constituted by a support section 1, a punch 2 mounted on the support section 1, a die 3, a lifting mechanism 4, and a connecting member 5 connecting the lifting mechanism 4 to the punch 2.

The support section made of steel plates and other elements as a forming material having sufficient strength, is provided, for setting a material A, with an inserting groove 11, which is formed at the middle part extending inwardly from one end of the support section 1, so that the general sectional form thereof will be a generally C-shape.

This support section 1 is constituted of an upper half 1*a* and a lower half 1*b* with the above-mentioned inserting groove 11 formed therebetween. The lower surface 12 of the lower half 1*b* has a dovetail groove 13 for setting the punching unit on a base plate of the punching apparatus. In the upper surface 14 of the upper half 1*a* also is provided a dovetail groove 15 for movably mounting the lifting mechanism 4. Furthermore, in one side end of the upper half 1*a* is formed a mounting bore 16 extending from the upper surface 14 to the inserting groove 11, for mounting the punch 2. In the lower half 1*b* on the downward extension of the axial center line of this mounting bore 16, a step section 17 for mounting the die 3 is provided open to the inserting groove 11. Furthermore, a slug discharge bore 18 is formed through from the step 17 to the lower surface 12 of the lower half 1*b*. Beneath this slug discharge bore 18 is mounted a slug discharge chute 6.

The punch 2 is provided with a shank 21 vertically moveable and removably inserted in the above mentioned mounting bore 16, a working surface 22 of concave form mounted on the lower end of the shank 21, and a cushioning material 23 for covering the outer periphery of the working surface 22.

The die 3 has a die opening 31 so formed as to conform to the shape of the outer periphery of the working surface 22 of the punch 2, and a slug discharge bore 32 continuing therewith and open to the above mentioned slug discharge bore 18. This die 3 is fixedly mounted by a bolt 7 to the lower half 1*b* of the support section 1.

The lifting mechanism 4 has a moving section 42 which is provided with a dovetail groove 41 in the lower surface which slides on the upper surface 14 of the upper half 1*a* of the support section 1, and a piston mechanism 43 supported by the moving section 42. In the above-mentioned dovetail groove 41 is fitted a slider 8 fastened by a locking bolt 44. The slider 8 is also inserted in the dovetail groove 15 provided in the upper half 1*a* of the support section 1. Turning the locking bolt 44 locks the moving section 42 to, and unlocks it from, the upper half 1*a* of the support section 1. The piston mechanism 43 has a piston 43*b* fitted in a cylinder 43*a* and a shaft 43*c* fixed in the piston 43*b*. On the lower end of the shaft 43*c* is mounted a locking section 43*d*. For driving this piston mechanism 43, it is possible to select any desired driving power source such as a pneumatic pressure, an oil hydraulic pressure, and electrical excitation.

The connecting member 5 includes a bifurcated portion 51 which engages with the above-mentioned locking section 43*d* and a screwing portion 52 which fits the upper end of the punch 2.

Near the aforementioned mounting bore 16 in the upper half 1*a* of the support section 1 and near the piston mechanism 43 of the moving section 42, stress absorbing sections 19 and 45 are provided, having two pin holes 19*a* and two pin holes 45*a*—,—respectively. The pin holes 19*a* are connected by a curved cut 19*b*, and the pin holes 45*a*, by a curved cut 45*b*, thereby absorbing the stress caused by the application of the punching pressure.

Figure 2:
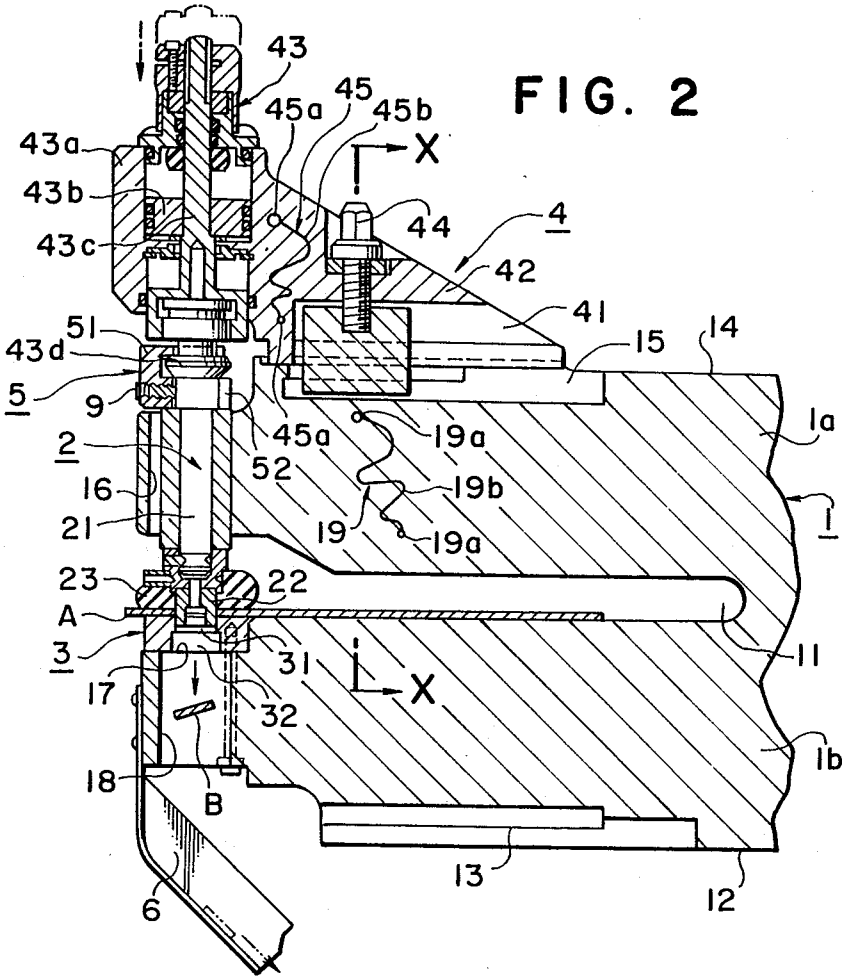
FIG. 2 is a sectional view showing the state of the punching unit of FIG. 1 after installation.

According to the above-described embodiment, in the use of the punching unit, the locking bolt 44 is loosened and the moving section 42 is laterally moved toward the opposite side of the mounting bore 16 as shown in FIG. 1. Then, the punch 2 having the working surface 22 of a desired shape is inserted into the mounting bore 16 described above, and the die 3 corresponding to the punch 2 is mounted by the mounting bolt 7 to the step section 17. Subsequently as shown in FIG. 2, the moving section 42 is slid to a position where the locking bolt 44 is tightened; the locking section 43*a* is locked by the bifurcated part 51 of the connecting member 5; the top end of the punch 2 is securely fastened with the screwing portion 52 by tightening a screw 9, thus connecting the lifting mechanism 4 (piston mechanism 43) and the punch 2. The replacement and maintenance of the punch 2 can very easily be performed by reversing the above-mentioned procedure.

After the installation of the punch 2 and other parts as described above, the material A is set in position. As the piston mechanism 43 is driven, the punch 2 moves downwardly, producing a hole by notching the material A between the punch 2 and the die 3. A slug B is discharged from the slug discharge openings 32 and 18 and through the slug discharge chute 6.

Effect of the Invention:

The punching unit for the punching apparatus according to the present invention, as described above, has such an effect as easy replacement and maintenance of the punch because of the utilization of the lifting mechanism operating mechanism of prior art.

Furthermore, because the material is notched to produce a hole with the concave section of the working surface of the punch and a slug thus produced is ejected downwardly from the slug discharge bore, the punching unit is fully applicable to producing relatively large holes.

What is claimed is:

1. A punching unit adapted to be used with a punching device said punching unit comprising:

(a) a generally C-shaped support having an upper section, within which a mounting bore is provided, and a lower section, wherein the material to be punched is positioned between said upper section and said lower section;

(b) a punch, vertically movable and removably inserted in said mounting bore, said punch having a lower, concave working surface, an outer periphery, and an upper attachment portion;

(c) a punch lifting assembly detachably, movably and removably positioned on said upper section of said support;

(d) means for detachably connecting said upper attachment portion of said punch to said lifting assembly, said connecting means being separate from said punch and said lifting assembly;

(e) a die having an opening complementary in shape to said outer periphery of said punch, said die being removably positioned within said lower section of said support; and (f) a slug discharge bore communicating between said die opening and said lower section of said support.

2. A punching unit for punching apparatus as claimed in claim 1, wherein said punch comprises a shank inserted in said mounting bore formed in said support section, and a working surface formed concave which is mounted on the bottom end of said shank.

3. A punching unit for punching apparatus as claimed in claim 2, wherein the outer periphery of said working surface of said punch is covered with a resilient cushioning material, and the lower edge of said cushioning material projects below the lower edge of said working surface such that, prior to punching, said cushioning material and said die cooperatively press to hold the material to be punched.

4. The punching unit of claim 1, wherein said punching unit is adapted to punch ceramic green sheets.

5. The punching unit of claim 1, wherein said punch lifting assembly is positioned on said upper section of said support by means of a slider removably attached to said lifting assembly, said upper section of said support further comprising a dovetail groove for receiving a complementary-shaped portion of said slider therein.

6. The punching unit of claim of claim 1, further comprising means for locking said lifting assembly to said upper section of said support.

7. The punching unit of claim 6, wherein said locking means comprises a slider, said slider being connected to said lifting assembly and having a portion which slides relative to said upper section of said support, thereby maintaining a connection with said upper section of said support, wherein said locking means further comprises means for adjusting the magnitude of a tightening force for enabling said lifting assembly to be locked to said upper section of said support.

8. The punching unit of claim 7, wherein said means for adjusting the magnitude of the tightening force comprises a locking bolt connecting said lifting apparatus with said slider.

9. The punching unit of claim 1, wherein said connecting means comprises means for a generally C-shaped device with an upper arm and a lower arm, said upper arm being adapted to engage said lifting mechanism and said lower arm being adapted to engage said upper attachment portion of said punch.

10. A punching unit adapted to be used with a punching device said punching unit comprising:

(a) a generally C-shaped support having (1) an upper section, within which a mounting bore is provided, wherein a curved cut is formed near said mounting bore, such that said support can absorb a stress caused by punching pressure, and (2) a lower section, wherein the material to be punched is positioned between said upper section and said lower section;

(b) a punch, vertically movable and removably inserted in said mounting bore, said punch having a lower, concave working surface, an outer periphery, and an upper attachment portion;

(c) a punch lifting assembly detachably, movably and removably positioned on said upper section of said support, said lifting assembly being removably connected to said punch;

(d) a die having an opening complementary in shape to said outer periphery of said punch, said die being removably positioned within said lower section of said support; and (e) a slug discharge bore communicating between said die opening and said lower section of said support.

11. The punching unit of claim 10, wherein said punch lifting assembly is movably positionable on said upper section of said support from a first position above the punch to a second position laterally removed from said first position.

12. A punching unit adapted to be used with a punching device said punching unit comprising:

(a) a generally C-shaped support having an upper section, within which a mounting bore is provided, and a lower section, wherein the material to be punched is positioned between said upper section and said lower section;

(b) a punch, vertically movable and removably inserted in said mounting bore, said punch having a lower, concave working surface, an outer periphery, and an upper attachment portion;

(c) a punch lifting assembly detachably, movably and removably positioned on said upper section of said support, said lifting assembly being removably connected to said punch, wherein said lifting assembly is disposed in a moving section having a curved cut, thereby enabling said moving section to absorb a stress caused by punching pressure;

(d) a die having an opening complementary in shape to said outer periphery of said punch, said die being removably positioned within said lower section of said support; and (e) a slug discharge bore communicating between said die opening and said lower section of said support.

13. The punching unit of claim 12, wherein said punch lifting assembly is movably positionable on said upper section of said support from a first position above the punch to a second position laterally removed from said first position.

* * * * *

UNITED STATES PATENT AND TRADEMARK OFFICE

CERTIFICATE OF CORRECTION

PATENT NO. : 4,979,415

DATED : December 25, 1990

INVENTOR(S) : M. KAKIMOTO

It is certified that error appears in the above-indentified patent and that said Letters Patent is hereby corrected as shown below:

At column 1, line 32, insert ---,--- after "invention".

At column 1, line 43, change "Viz." ---viz.---.

At column 2, line 47, insert ---1,--- after "section".

At column 3, line 13, change "above mentioned" to ---above-mentioned---.

At column 3, line 42, change "-,-" to ---,---.

At column 6, line 24 (claim 12, line 16), insert ---which slides relative to said support section, said moving section--- after "section".

Signed and Sealed this

Twenty-ninth Day of November, 1994

*Attest:*

Bruce Lehman

BRUCE LEHMAN

*Attesting Officer*

*Commissioner of Patents and Trademarks*